US012029245B2

(12) United States Patent
Gordovskyi et al.

(10) Patent No.: US 12,029,245 B2
(45) Date of Patent: Jul. 9, 2024

(54) APPARATUS FOR HEATING AND VAPING SMOKABLE MATERIAL

(71) Applicant: WI LABS IP Holdings LLC, Reno, NV (US)

(72) Inventors: Anatolii Gordovskyi, Kyiv (UA); Dmitri Churakov, Tel Aviv (IL)

(73) Assignee: WI LABS IP Holdings LLC, Reno, NV (US)

( * ) Notice: Subject to any disclaimer, the term of this patent is extended or adjusted under 35 U.S.C. 154(b) by 710 days.

(21) Appl. No.: 17/175,623

(22) Filed: Feb. 13, 2021

(65) Prior Publication Data

US 2022/0046987 A1 Feb. 17, 2022

Related U.S. Application Data

(60) Provisional application No. 63/066,679, filed on Aug. 17, 2020.

(51) Int. Cl.

| | |
|---|---|
| ***A24F 40/05*** | (2020.01) |
| ***A24F 40/20*** | (2020.01) |
| ***A24F 40/42*** | (2020.01) |
| ***A24F 40/46*** | (2020.01) |
| ***A24F 40/50*** | (2020.01) |

(Continued)

(52) U.S. Cl.

CPC ..... *A24F 40/42* (2020.01); *A24F 40/46* (2020.01); *A24F 40/51* (2020.01); *A24F 40/53* (2020.01); *A24F 40/20* (2020.01)

(58) Field of Classification Search

None

See application file for complete search history.

(56) References Cited

U.S. PATENT DOCUMENTS

2015/0136124 A1* 5/2015 Aronie ..... A61M 15/0021 128/202.21
2019/0021400 A1* 1/2019 Fornarelli ..... A24F 40/60
(Continued)

FOREIGN PATENT DOCUMENTS

WO WO-2016154897 A1 * 10/2016 ..... A24F 47/00

OTHER PUBLICATIONS

WO2016154897A1 English Translation obtained from PE2E-SEARCH, pp. 1-14 (Year: 2023).*

*Primary Examiner* — Philip Y Louie
*Assistant Examiner* — Madeleine P Delacruz
(74) *Attorney, Agent, or Firm* — INVIENTA CAPITAL GROUP PLC

(57) ABSTRACT

A device for heating a smokable material includes an elongate housing assembly having a mouth end with an opening and an opposing open component end. The housing assembly includes a hollow inner tube longitudinally extending therethrough, wherein the inner tube is in fluid communication with the opening of the mouth end and the open component end. A cartridge contains the smokable material and is disposed within the inner tube. A main node assembly includes an upper portion and a lower portion, the upper portion is insertable through the open component end into the inner tube. The lower portion of the main node assembly includes a pressure sensor configured to detect a draw on the mouth end by the user and a membrane assembly configured to generate low-frequency air vibrations in response to a signal received from the pressure sensor.

20 Claims, 7 Drawing Sheets

(51) Int. Cl.
*A24F 40/51* (2020.01)
*A24F 40/53* (2020.01)

(56) References Cited

U.S. PATENT DOCUMENTS

2020/0237016 A1* 7/2020 Wang ..... A24F 40/42
2022/0183383 A1* 6/2022 Chen ..... A24F 40/50

* cited by examiner

APPARATUS FOR HEATING AND VAPING SMOKABLE MATERIAL

FIELD OF INVENTION

The invention relates to the technical field of vaping devices such as electronic cigarettes.

BRIEF DESCRIPTION OF THE INVENTION

The art is replete with various prior art design of vaping devices. Most of the vaping devices such as sticks, vape pens, loose leaf filling material, liquid-based, and oil-based with any heating circuit pass the air that is being inhaled through the heated material. When the concentration of aerosol decreases, the material starts to produce new aerosol, while the air that goes through the material cools it down. Most devices take 20 to 30 seconds to restore the heat loss that appeared during the air transition. Needless to say, there are devices similar to Glo that due to the large thermal contact, can restore the heat loss very quickly, but why lose it at all.

Unfortunately, these prior art design present numerous disadvantages including and not limited to redundant parts count that makes its hard to assemble/disassemble. There is always a need for an improved device that is easy to assemble/disassemble and manufacture.

SUMMARY OF THE INVENTION

A device for heating a smokable material to generate a compound inhalable by a user includes an elongate housing assembly having a sidewall with an outer surface and an interior surface. The housing assembly includes a hollow inner tube longitudinally extending therethrough, wherein the inner tube is spaced from the interior surface of the sidewall of the housing assembly. A cartridge contains the smokable material and is disposed within the inner tube. A main node assembly comprises an upper portion and a lower portion. The upper portion is configured to be inserted into the inner tube, wherein the lower portion of the main node assembly includes a pressure sensor configured to detect a drop in pressure in the inner tube and a membrane assembly configured to generate low-frequency air vibrations in response to a signal received from the pressure sensor. A pin heater is configured to be securely received by the upper portion of the main node assembly. The sidewall of the housing assembly defines an aperture, wherein the housing assembly includes an air canal extending between the inner tube and the interior surface of the sidewall. The canal is connected in fluid communication with the aperture and the inner tube to provide an air supply into the inner tube through the air canal. The pin heater is configured to be inserted into the cartridge and selectively activated to heat and volatilize the smokable material.

An advantage of the present invention is to provide an inventive vaping device wherein air does not pass thought the heater wherein vibration from speaker push out vape from the sealed volume then mixes it with cold air.

Another advantage of the present invention is to provide an inventive vaping device because a Accordingly, the present invention provides a vapor-generating device that produces a concentrated vapor of active ingredients of a consumable substance, which concentrated vapor is forced to separate away from the consumable substance by air vibrations or sound waves and mix with an ambient air outside of the cartridge containing the consumable substance for consumption by the user. The forceful separation of the vapor of active ingredients away from the consumable substance and later mixing with an ambient air to form a compound consumable by the user provides for an improved delivery of the compound to the user and allows the consumable substance to maintain a desired temperature for subsequently quick vaporization.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
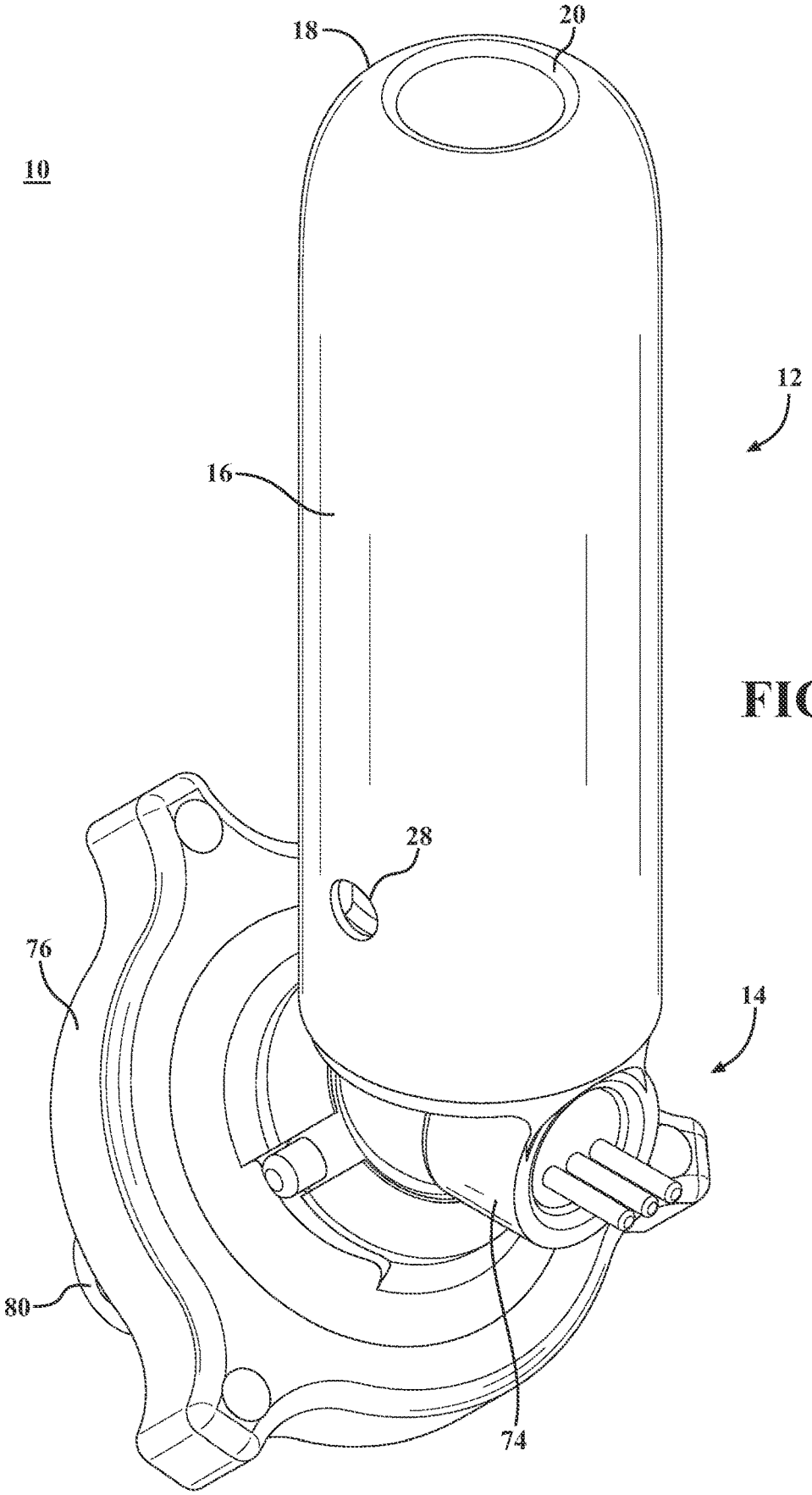
FIG. 1 illustrates a general front view of a vaping device of the present invention.

Referring to description of the present invention, the words "inner", "inwardly" and "outer", "outwardly" refer to directions toward and away from, respectively, a designated centerline or a geometric center of an element being described, the particular meaning being readily apparent from the context of the description. Additionally, as used herein, the singular forms "a," "an," and "the" include plural referents unless the context clearly dictates otherwise.

Thus, for example, the term "module" is intended to mean one or more modules or a combination of modules. Furthermore, as used herein, the term "based on" includes based at least in part on. Thus, a feature that is described as based on some cause, can be based only on that cause, or based on that cause and on one or more other causes.

It will be apparent that multiple embodiments of this disclosure may be practiced without some or all of these specific details. In other instances, well-known process operations have not been described in detail in order not to unnecessarily obscure the present embodiments. The following description of embodiments includes references to the accompanying drawing. The drawing shows illustrations in accordance with example embodiments.

These example embodiments, which are also referred to herein as "examples," are described in enough detail to enable those skilled in the art to practice the present subject matter. The embodiments can be combined, other embodiments can be utilized, or structural, logical and operational changes can be made without departing from the scope of what is claimed. The following detailed description is, therefore, not to be taken in a limiting sense, and the scope is defined by the appended claims and their equivalents.

Alluding to the above, for purposes of this patent document, the terms "or" and "and" shall mean "and/or" unless stated otherwise or clearly intended otherwise by the context of their use. The term "a" shall mean "one or more" unless stated otherwise or where the use of "one or more" is clearly inappropriate. The terms "comprise," "comprising," "include," and "including" are interchangeable and not intended to be limiting. For example, the term "including" shall be interpreted to mean "including, but not limited to."

Accordingly, as used herein, terms such as "identifier of an object" and "memory address of an object" should be understood to refer to the identifier (e.g., memory address) itself or to a variable at which a value representing the identifier is stored. As used herein, the term "module" refers to a combination of hardware (e.g., a processor such as an integrated circuit or other circuitry) and software (e.g., machine- or processor-executable instructions, commands, or code such as firmware, programming, or object code). A combination of hardware and software includes hardware only (i.e., a hardware element with no software elements), software hosted at hardware (e.g., software that is stored at a memory and executed or interpreted at a processor), or at hardware and software hosted at hardware.

Referring now to the drawings and the illustrative embodiments depicted therein, an electrically operated aerosol or vapor-generating apparatus, vaporizer, device or system 10, as shown in FIG. 1, is provided for selectively heating a smokable material or vapor-forming substrate disposed therein to generate a compound, vapor or aerosol that can be consumed or inhaled by a user. The vapor-generating device 10 includes a vaporizer housing assembly 12 and a main node assembly 14 that are configured to securely couple together, either threadably, by press-fit, by one or more fasteners, or other mechanical means, to form the vapor-generating device for selectively producing a vapor, which is inhalable or consumable by a user.

Figure 3:
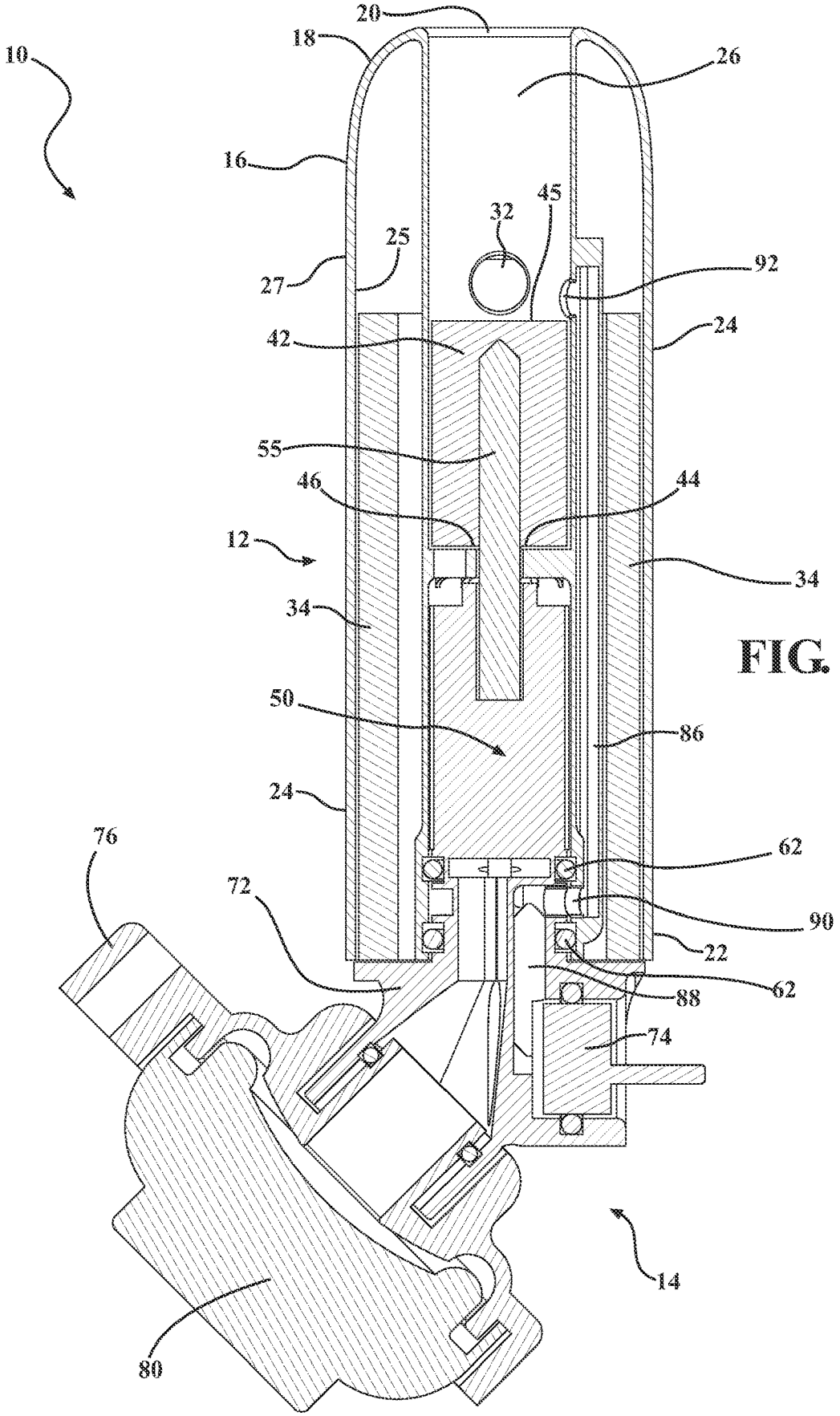
FIG. 3 illustrates a cross sectional view of the vaping device of the present invention.
Figure 4:
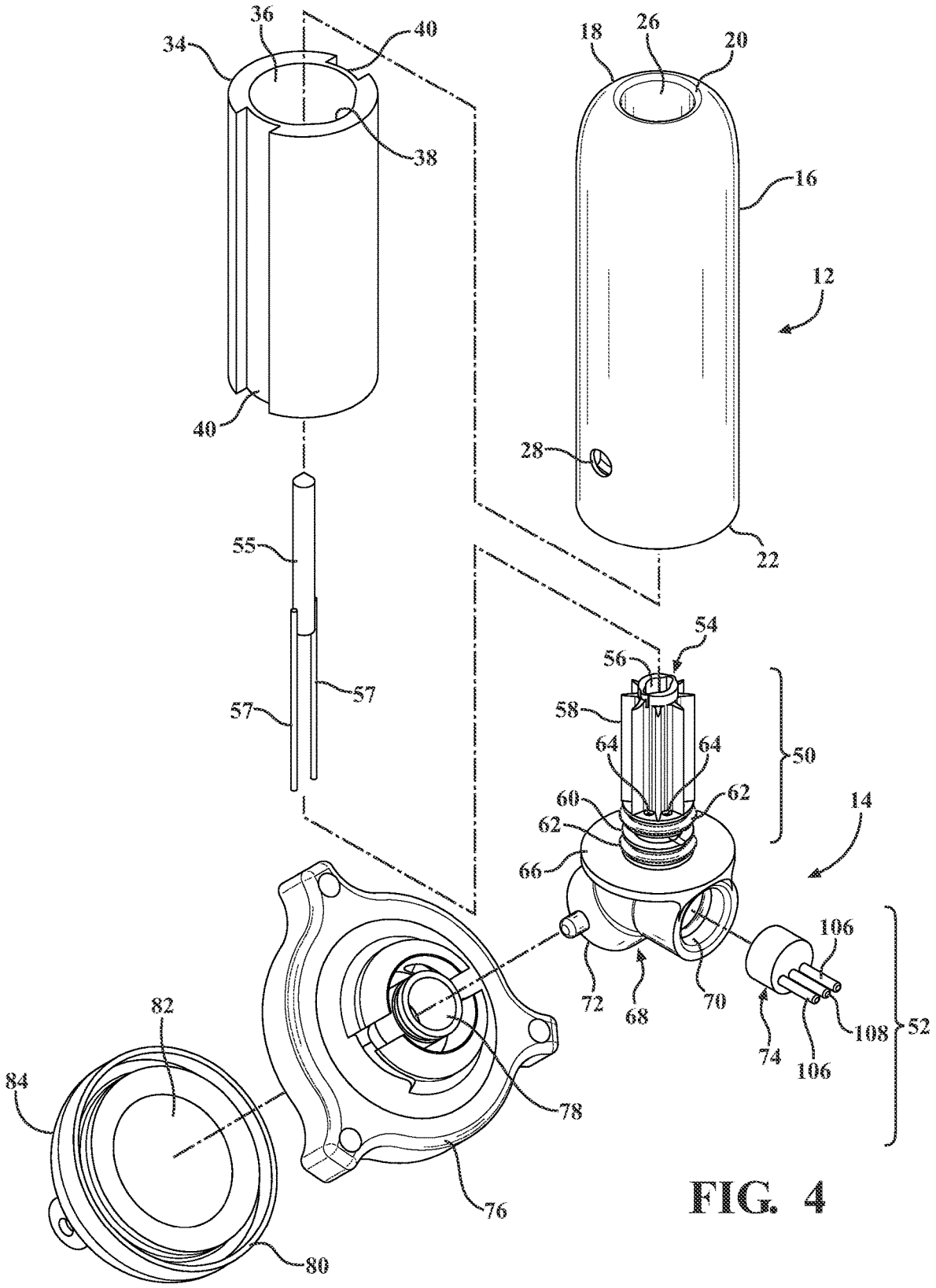
FIG. 4 illustrates an exploded view of the vaping device of the present invention.

With reference to FIGS. 3 and 4, the vaporizer housing assembly 12 includes an elongate housing 16 having a mouthpiece end portion 18 defining a generally central opening 20, an opposing open component end portion 22, and a generally cylindrical or frusto-conical sidewall 24 having an interior surface 25, an exterior surface 27, with the sidewall 24 extending between the open component end portion 22 and the mouthpiece end portion 18. The elongate housing 16 defines a generally hollow chamber and includes a concentric hollow inner tube 26 internally and longitudinally extending through the elongate housing 16, such that the inner tube 26 is in fluid communication with the central opening 20 and the open component end portion 22. The diameter of the inner tube 26 is substantially smaller than that of the elongate housing 16, and thus the inner tube 26 is spaced from the inner surface 25 of the elongate housing 16, such as shown in FIG. 3. In the illustrated embodiment, the mouthpiece end portion 18 includes beveled edges or a shape having a reducing dimension along its longitudinal axis, such as a conical or funnel shape that tapers towards the generally central opening 20.

Figure 6:
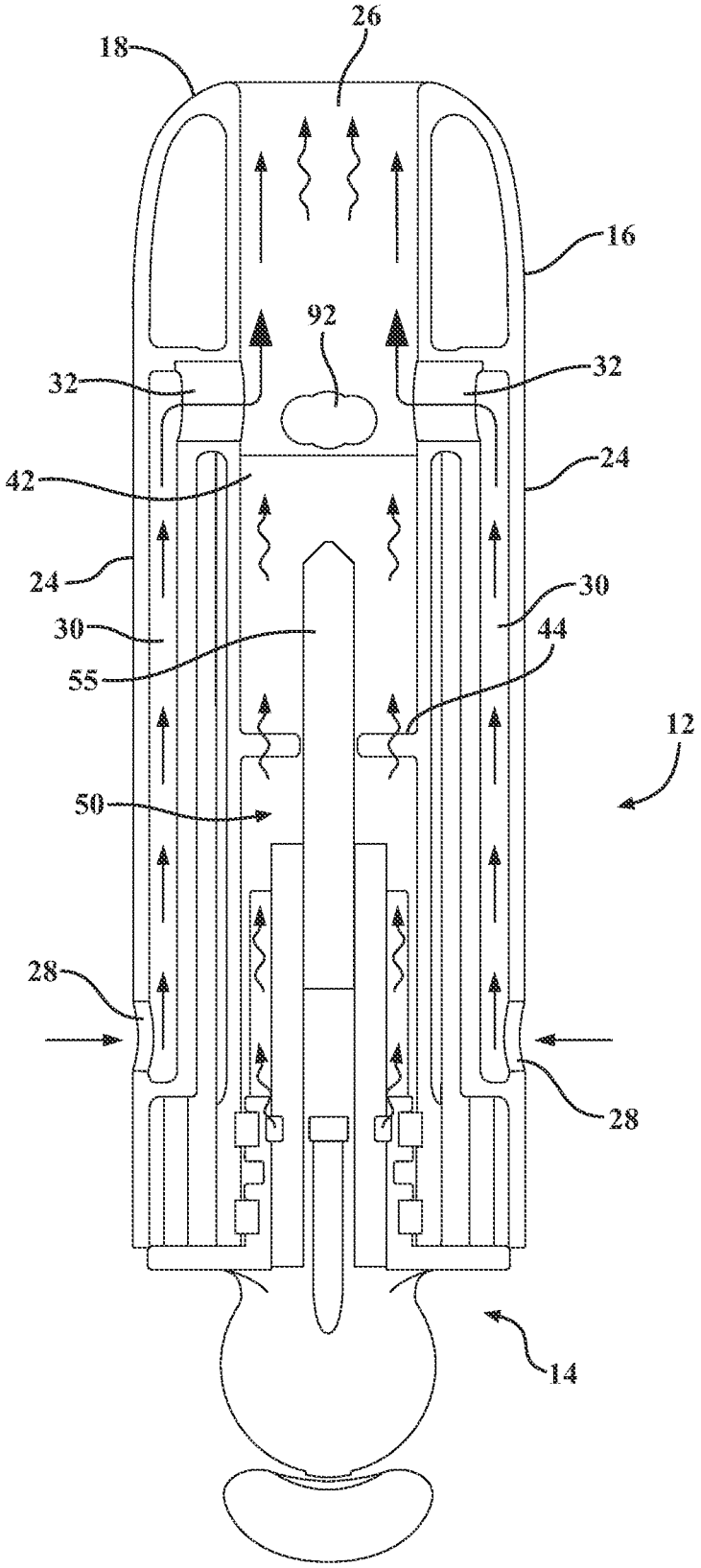

As shown in FIGS. 1, 4 and 6, the sidewall 24 of elongate housing 16 includes or defines a pair of opposing apertures 28 that are generally open to the external environment of the vaporizer housing assembly 12. The vaporizer housing assembly 12 further includes a pair of air canal members 30 (FIG. 6) that longitudinally extend between the inner tube 26 and the interior surface 25 of the sidewall 24 of the elongate housing 16. As can be best seen in FIG. 6, each of the pair of air canal members 30 is connected in fluid communication with a respective one of the pair of apertures 28 and with the inner tube 26 through a respective air duct 32. Since it should be appreciated that the vapor-generating device 10 is a device used to vaporize active ingredients of a consumable substance to produce a vapor that is inhalable or consumable by a user, it will be understood that whenever the user draws on the mouthpiece end portion 18, an ambient or external air supply will be provided into the inner tube 26 through the pair of apertures 28, air canal members 30, and air ducts 32, such as shown generally with straight arrows in FIG. 6. Although in the illustrated embodiment of FIG. 6 there are two apertures 28 each fluidly connected with a respective air canal member 30, there can be one or more than two apertures 28 each fluidly connected via a respective air canal member 30 and air duct 32 with the inner tube 26.

Figure 5:
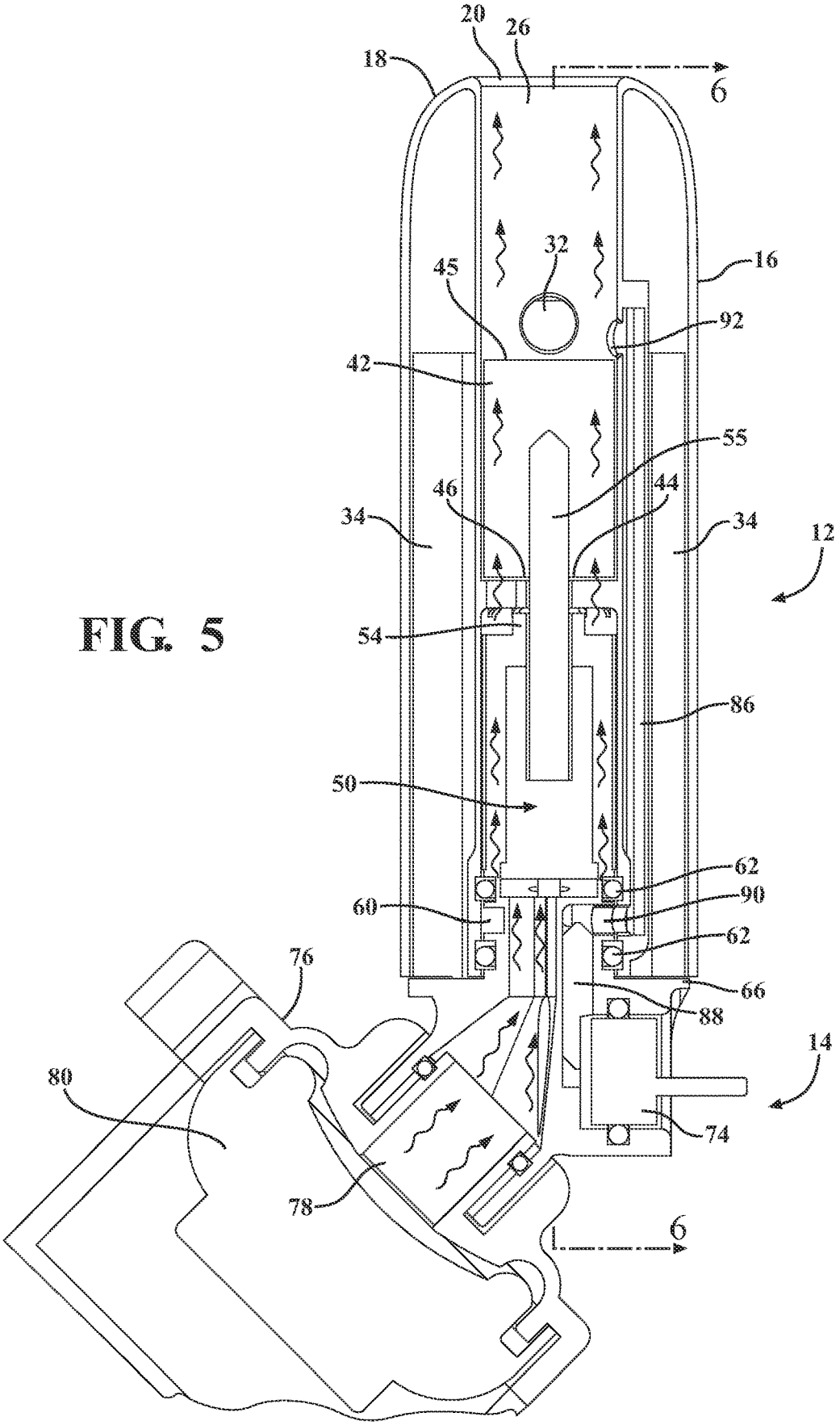
FIGS. 5 and 6 illustrate cross sectional views of the vaping device of schematically showing working principles of the present invention.

Turning now to FIGS. 3, 4 and 5, the vaporizer housing assembly 12 further includes a thermal isolation sleeve 34 configured to be inserted through the open component end portion 22 so that the thermal isolation sleeve 34 relatively snugly fits over and surrounds at least a substantial portion of the inner tube 26. As shown in FIG. 4, the thermal isolation sleeve 34 is formed generally as a cylinder with a central opening 36 that is extending therethrough and configured to receive the inner tube 26. In the illustrated embodiment, the hollow central opening 36 has an egg-like shape and includes a recess 38 concaving into an interior wall of the thermal isolation sleeve 34. The thermal isolation sleeve 34 further includes a pair of grooves 40 longitudinally extending along an exterior wall of the thermal isolation sleeve 34. Each groove 40 is configured to receive and/or guide at least a portion of a respective air canal member 30 of the vaporizer housing assembly 12. It will be appreciated that the thermal isolation sleeve 34 is formed and designed to provide thermal isolation for the inner tube 26 to ensure that thermal loss within and out of the inner tube 26 is minimized.

Figure 2:
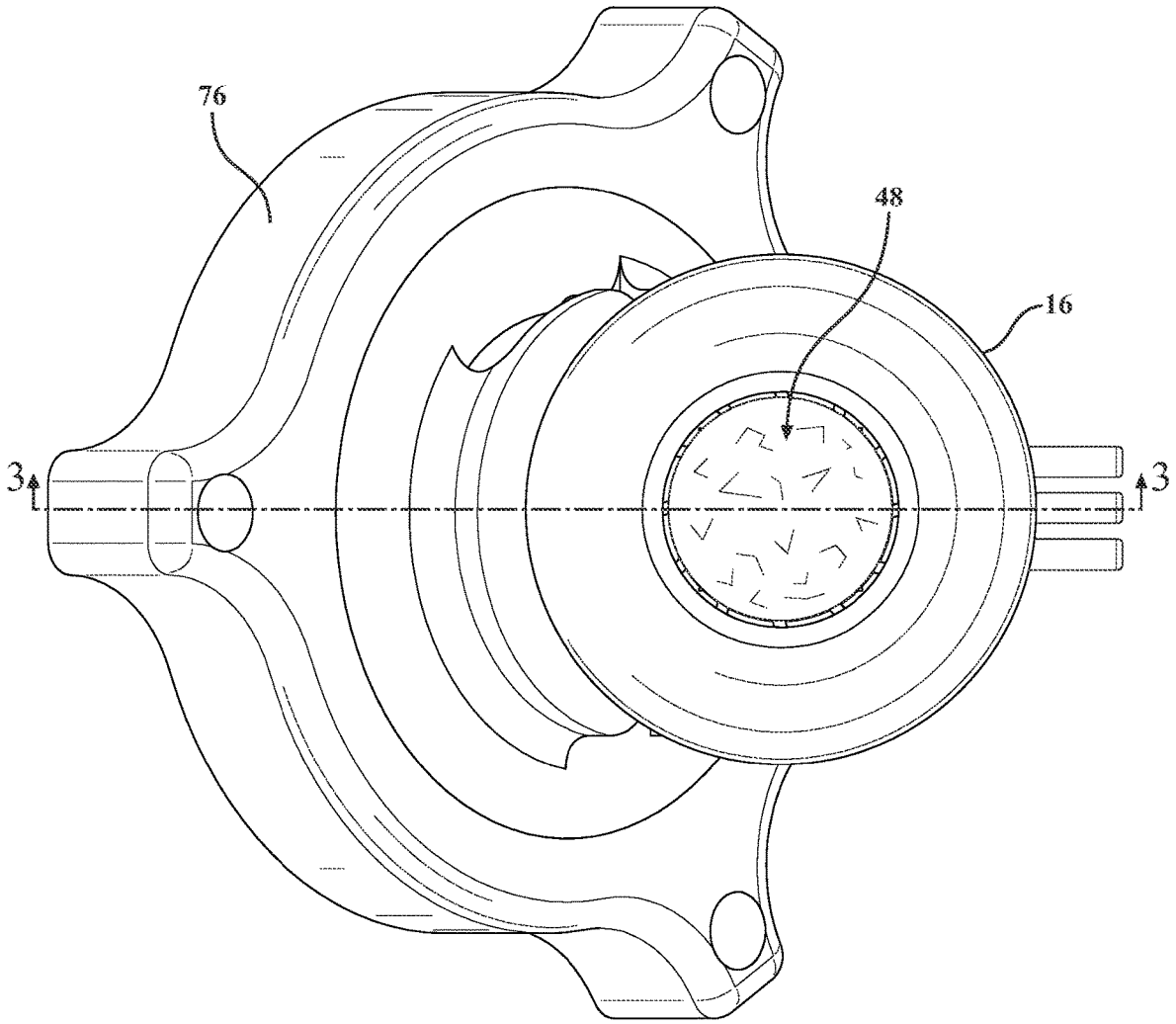
FIG. 2 illustrates a top view of a speaker section of the vaping device.

With reference to FIGS. 3, 5 and 6, the vaporizer housing assembly 12 further includes a cartridge 42 with a bottom wall 44 and a generally cylindrical sidewall extending from the bottom wall 44 and having an open upper end portion 45. The bottom wall 44 of the cartridge 42 defines or includes a generally central hole 46 and a plurality of smaller holes (not shown). The cartridge 42 is disposed within the inner tube 26 and configured to contain a consumable substance or smokable material 48 (FIG. 2), such as herbs or typically dried plant materials, including tobacco, cannabis, eucalyptus, shisha, blends of plant materials, and other vaporizable substances. Generally, vapor-generating device 10 is configured to selectively heat the consumable substance 48 until the active ingredients of the consumable substance 48 are released or vaporized into the inner tube 26, at which point the vapor so produced may be inhaled or consumed by the user, as will be described in more detail below.

Turning now to FIG. 4, the main node assembly 14 includes an upper node portion 50 and a lower node portion 52. The upper node portion 50 is configured to be inserted into the inner tube 26 of the elongate housing 16 and includes a generally cylindrical and longitudinally extending node member 54 with a generally oval-shaped cavity 56 extending therethrough. The node member 54 includes a plurality of fins or ribs 58 spaced from one another and longitudinally extending along the node member 54, and each transversely extending relative to the node member 54 in a fan-like pattern, i.e., with each fin 58 diverging from an adjacent fin 58 at an angle. It should be appreciated that the fan-like pattern of the fins 58 was implemented to increase and distribute heat transfer areas of the node member 54 so as to decrease the amount of condensation that may accumulate around the node member 54.

The upper node portion 50 further includes an intermediate neck member 60 disposed below the node member 54 with the plurality of fins 58. The intermediate neck member 60, which is generally cylindrically-shaped, includes a top and bottom surface and a sidewall therebetween, with the top and bottom surfaces oriented perpendicularly to the longitudinally extending node member 54.

In the illustrated embodiment of FIG. 4, the sidewall of the intermediate neck member 60 includes a pair of sealing rings 62 adapted to facilitate an interference fit of the upper portion 50 with the inner tube 26. The intermediate neck member 60 further includes a plurality of spaced-apart air vibration nozzles 64 extending through the top and bottom surfaces of the intermediate neck member 60, with each air vibration nozzle 64 disposed between a respective pair of the fins 58, such as shown in FIG. 4. The bottom surface of the intermediate neck member 60 rests on a generally circular base member 66, which separates the upper node portion 50 from the lower node portion 52. The base member 66 is configured to abut and cover the open component end 22 of the elongate housing 16 when the upper node portion 50 is inserted into the inner tube 26.

As shown in FIG. 4, the oval-shaped cavity 56 of the node member 54 is configured to securely receive a heatable element, heatable needle or pin heater 55, upper portion of which is insertable through the central hole 46 in the bottom wall 44 of the cartridge 42 into the smokable material 48. It will be understood that while a lower portion of the pin heater 55 is secured within the cavity 56, at least an upper portion of the pin heater 55 is adapted to be selectively heated to sublime the smokable material 48 so that the active ingredients of the smokable material 48 are released or vaporized for consumption by the user.

Figure 7:
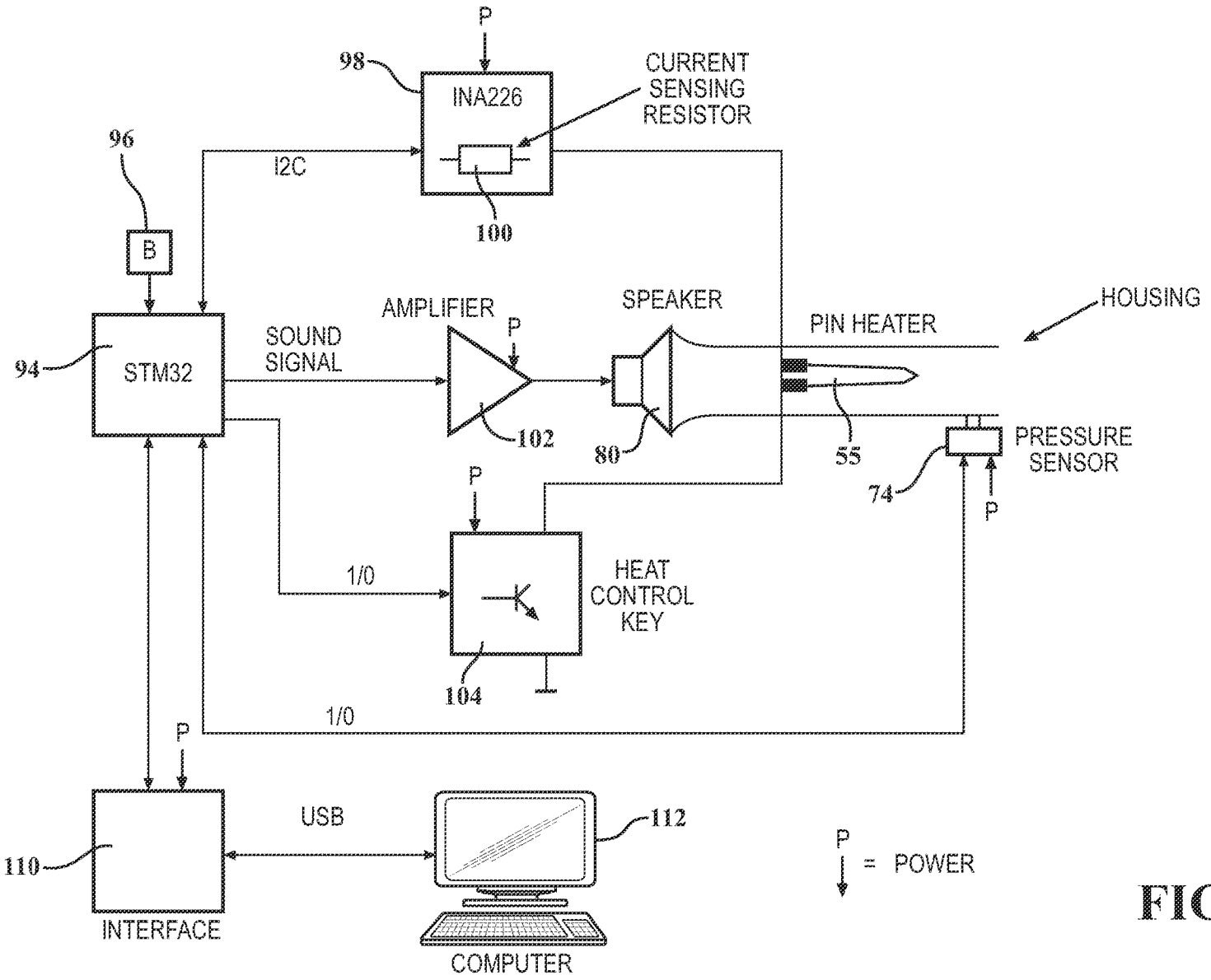
FIG. 7 illustrates a schematic view of electronic components of the vaping device.

The lower portion of the pin heater 55 includes a pair of electrical wires 57, as shown in FIG. 4, that are connectable to a power supply or source, such as for example a lithium-ion battery 96 (FIG. 7). It will be understood that the cavity 56 of the node member 54 is specifically shaped generally as an oval to receive not only the pin heater 55 but also the pair of electrical wires 57. It is contemplated that the pin heater 55 is formed of metal, such as copper, aluminum or the like, but may also be formed of other thermal-conductive materials, such as graphite for example.

The lower node portion 52 of the main node assembly 14 includes a manifold 68 having a first opening 70 and a second opening 72, a pressure sensor 74 insertable or mountable into the first opening 70, an adaptor 76 insertable or mountable into the second opening 72, and a membrane assembly 80 having a front side 82 and a back side 84, and is configured to be mounted into or coupled with the adaptor 76, such as shown in FIG. 4. As can be seen in FIG. 4, the adaptor 76 is configured to entirely cover at least the front side 82 of the membrane assembly 80 and includes a generally central opening 78 extending therethrough. The adaptor 76 is configured to receive and securely connect with the membrane assembly 80 either threadably, by press-fit, by one or more fasteners, or other mechanical means.

The membrane assembly 80 is configured to oscillate at a frequency of approximately 10-1000 Hertz to generate low-frequency air vibrations or sound waves in response to a signal received from the pressure sensor 74, as will be described in more detail below. It will thus be appreciated that the membrane assembly 80 is contemplated as a diaphragm that, in response to an electrical signal, produces or pushes on the air waves, shown generally as vibrating arrows in FIG. 5. It is also contemplated, however, that the membrane assembly 80 may be replaced by or substituted for a piston moveable within a piston chamber to produce or push on the air waves.

Alluding to the above, at least the second opening 72 of the manifold 68 is connected in fluid communication with the air vibration nozzles 64, such that the low-frequency air vibrations produced by the membrane assembly 80 are bound to travel through the adaptor's central opening 78, the manifold's second opening 72 and exit or escape through the air vibration nozzles 64, and further travel along and between the fins 58 of the upper node portion 50 and into the inner tube 26 of the elongate housing 16, such as shown in FIG. 5.

Turning now to FIGS. 3-5, the vaporizer housing assembly 12 further includes a hollow transit duct 86 longitudinally extending between the inner tube 26 and the interior surface 25 of the sidewall 24 of the elongate housing 16 and connecting in fluid communication the pressure sensor 74 with the inner tube 26. The transit duct 86 is fed through and along the recess 38 in the interior wall of the thermal isolation sleeve 34. As can be best seen in FIGS. 3 and 5, the transit duct 86 is fluidly connected with the pressure sensor 74 via a longitudinal and lateral pressure sensor channels 88 and 90, and is fluidly connected with the inner tube 26 via a transfer opening 92.

Due to the pressure sensor's fluid communication with the inner tube 26, the pressure sensor 74 is configured to detect or sense a pressure drop in the inner tube 26 and/or the transit duct 86 that can typically be associated with the user drawing on the mouthpiece end portion 18. Once the pressure drop is detected, the pressure sensor 74 provides a signal that prompts the membrane assembly 80 to oscillate and produce the low-frequency air vibrations, as will be described in more detail below. It is also contemplated, however, that the signal that prompts the membrane assembly 80 to oscillate and produce the low-frequency air vibrations may be provided by the user pushing on or pressing a button that may be disposed anywhere on the vapor-generating device 10.

With reference to FIG. 7, the lower node portion 52 of the main node assembly 14 further incudes a microprocessor or central processing unit (CPU) 94 that is electrically and communicatively connected to the pressure sensor 74, membrane assembly 80 and heatable element 55, and is operable to control the pressure sensor 74, membrane assembly 80, and heatable element 55. As shown in FIG. 7, the power supply or battery 96 is connected through the CPU 94 to provide power to various electrical components of the vapor-generating device 10, including the pressure sensor 74, membrane assembly 80 and heatable element 55. It is envisioned that other electrical components of the vapor-generating device 10 include (1) INA226-type current and power monitoring controller or module 98 that contains a current sensing resistor 100 and is responsible for measuring current and resistance in the pin heater 55, (2) an amplifier 102 configured to amplify or strengthen an electrical audio signal transmitted by the CPU 94 to the membrane assembly 80, (3) a heat control key or module 104 that includes one or more transistors and resistors to control and maintain a desired temperature of the pin heater 55 when the vapor-generating device 10 is not in use, as well as during the use of the device 10, and (4) an interface or visual display 110 of the vapor-generating device 10. In the illustrated embodiment, the CPU 94 can be selected from the STM 32 family of microcontrollers.

It is contemplated that the CPU 94 is communicatively connected with the pin heater 55 via the current and power monitoring module 98 by I2C communication standard. The CPU 94 also communicates with the pin heater 55 via the heat control key 104 by the 1/0 logical input/output variables. The CPU 94 further communicates with the pressure sensor 74 by the 1/0 logical input/output variables. As shown in FIG. 4, the pressure sensor 74 includes a pair of contacts 106 electrically connectable to the power source 96 (FIG. 7) and at least one logical output contact 108 configured to transmit an electrical audio signal from the CPU 94 to the membrane assembly 80, which converts or transforms the signal received from the CPU 94 into the low-frequency air vibrations. It is further envisioned within the scope of the present invention that the vapor-generating device 10 may include a USB port, via which device 10 would be able to communicate with an external computing device 112 to monitor and/or troubleshoot the device 10, receive updates, transfer data, and the like.

During operation or in use, whenever the user inhales or draws on the mouthpiece end portion 18 of the elongate housing 16, the pressure sensor 74 detects or senses a pressure drop in the transit duct 86 and/or the inner tube 26. In response to the pressure drop, the pressure sensor 74 sends a signal to the CPU 94. Having received the signal from the pressor sensor 74, the CPU 94 sends an electrical audio signal to the membrane assembly 80, in response to which the membrane assembly 80 begins to oscillate and produce the low-frequency air vibrations. The low-frequency air vibrations are bound to travel through the main node assembly 14, the cartridge 42, along the inner tube 26 and towards the central opening 20, as described above. Concurrently, the CPU 94 prompts the pin heater 55 to heat or activate to a desired temperature to begin subliming or vaporizing the smokable material 48. The smokable material 48 heated by the pin heater 55 begins to emit active ingredients as vapor, which is pushed, driven, or forced to travel along the inner tube 26 and towards the central opening 20 of the elongate housing 16 by the low-frequency air vibrations.

As the user draws on the mouthpiece end portion 18 of the elongate housing 16, an external or ambient air is forced through the air canal members 30 into an upper portion of the inner tube 26, as shown in FIG. 6 and described above. As a result, the ambient air is mixed with the vapor of active ingredients of the smokable material 48 in the inner tube 26 and above the open upper end portion 45 of the cartridge 42, thereby not cooling the contents of the cartridge 42, which helps maintain the desired temperature within the cartridge 42. As the ambient air is mixed with the vapor of active ingredients in the inner tube 26 outside of the cartridge 42, the compound so formed is then inhaled by the user.

It should be appreciated that the CPU 94 is configured to maintain the pin heater 55, and subsequently the smokable material 48, at a predetermined temperature so that the smokable material 48 is sublimed or vaporized relatively quickly once the pin heater 55 is activated. It is further contemplated within the scope of the present invention that the pin heater 55 may be automatically or draw-activated and/or by the user pushing on or pressing the button provided on the device 10. Also, the device 10 may include a timer configured to monitor a prolonged idle time or inactivity of the device 10 to stop maintaining or reduce the predetermined temperature of the pin heater 55 in order to preserve charge in the battery.

Accordingly, the present invention provides a vapor-generating device that produces a concentrated vapor of active ingredients of a consumable substance, which concentrated vapor is forced to separate away from the consumable substance by air vibrations or sound waves and mix with an ambient air outside of the cartridge containing the consumable substance for consumption by the user. The forceful separation of the vapor of active ingredients away from the consumable substance and later mixing with an ambient air to form a compound consumable by the user provides for an improved delivery of the compound to the user and allows the consumable substance to maintain a desired temperature for subsequently quick vaporization.

Changes and modifications in the specifically-described embodiments may be carried out without departing from the principles of the present invention, which is intended to be limited only by the scope of the appended claims as interpreted according to the principles of patent law including the doctrine of equivalents.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A device for heating a smokable material to generate a compound inhalable by a user, said device comprising:

an elongate housing assembly having a mouth end portion with a central opening, an opposing open component end portion, a hollow inner tube longitudinally extended and a sidewall extending between said mouth end portion and said open component end portion;

a cartridge containing the smokable material, said cartridge is disposed within said elongate housing assembly; and a main node assembly configured to couple through said open component end portion with said elongate housing assembly, wherein said main node assembly comprises (i) a pressure sensor configured to detect a pressure drop in said elongate housing assembly, (ii) a heatable element insertable into said cartridge and configured to be selectively activated to heat and volatilize the smokable material, (iii) a membrane assembly configured to generate low-frequency air vibrations, and (iv) a central processing unit (CPU) configured to control said heatable element, pressure sensor and membrane assembly;

wherein said pressure sensor, in response to the pressure drop, is configured to generate and send a signal to said CPU, and wherein said CPU, in response to the signal, is configured to transmit an electrical audio signal to said membrane assembly to produce the low-frequency air vibrations, wherein the low-frequency air vibrations are bound to travel through the main node assembly, the cartridge, along the inner tube and towards the central opening of the device, which is designed to mix an ambient air with forced separated concentrated vapor from the consumable substance by air vibrations formed by the membrane assembly within a plurality of spaced-apart air vibration nozzles, and wherein each of the spaced-apart air vibration nozzles are in fluid communication with the main node assembly.

2. A device for heating a smokable material to generate a compound inhalable by a user, said device comprising:

an elongate housing assembly having a mouth end portion with a central opening, an opposing open component end portion, and a sidewall extending between said mouth end portion and said open component end portion, said housing assembly comprising a hollow inner tube longitudinally extending therethrough, wherein said inner tube is in fluid communication with said opening of said mouth end portion and said open component end portion;

a cartridge containing the smokable material, said cartridge is disposed within said inner tube; and a main node assembly comprising an upper portion and a lower portion, said upper portion is insertable through said open component end portion into said inner tube, wherein said lower portion of said main node assembly comprises (i) a pressure sensor configured to detect a draw on said mouth end portion by the user and (ii) a membrane assembly configured to generate low-frequency air vibrations in response to a signal received from said pressure sensor;

wherein said upper portion of said main node assembly is adapted to securely receive a heatable element that is configured to couple with said cartridge and to be activated to heat and volatize the smokable material, wherein the upper portion of the main node assembly comprises a plurality of spaced-apart air vibration nozzles each in fluid communication with a second opening of a manifold of the lower node portion, wherein each of the air vibration nozzles is disposed between a respective pair of fins of a longitudinally extending node member that longitudinally extend along the upper portion of the main node assembly such that the low-frequency air vibrations generated by the membrane assembly exit the air vibration nozzles and travel upwards between the respective pair of fins and into said inner tube of the housing assembly, and wherein the low-frequency air vibrations are bound to travel through the main node assembly, the cartridge, along the inner tube and towards the central opening of the device, which is designed to mix an ambient air with forced separated concentrated vapor from the consumable substance by air vibrations formed by the membrane assembly.

3. The device as claimed in claim 2 or claim 1, wherein said sidewall of said housing assembly defines an aperture, wherein said housing assembly comprises an air canal longitudinally extending between said inner tube and an interior surface of said sidewall of said housing assembly, and wherein said air canal is connected in fluid communication with said aperture and said inner tube such that, in response to the draw on said mouth end portion by the user, an air supply into said inner tube is provided through said air canal.

4. The device as claimed in claim 2 or claim 1, wherein said cartridge containing the smokable material comprises an open end through which volatilized smokable material enters said inner tube of said housing assembly and mixes with the air supply delivered through said air canal into said inner tube to form the compound inhalable by the user.

5. The device as claimed in claim 2 or claim 1, further comprising a thermal isolation sleeve fitted over said inner tube of said housing assembly, said thermal isolation sleeve comprising a groove longitudinally extending along said thermal isolation sleeve and configured to receive at least a portion of said air canal.

6. The device as claimed in claim 2 further comprising a central processing unit (CPU) communicatively connected to said pressure sensor, membrane assembly and heatable element, wherein said CPU is operable to control said pressure sensor, membrane assembly and heatable element.

7. The device as claimed in claim 2 or claim 1, further comprising a power supply that is connected through said CPU with said pressure sensor.

8. The device as claimed in claim 2 or claim 1, wherein said pressure sensor comprises a pair of contacts electrically connected with said power supply and at least one logical output contact configured to transmit an electrical audio signal from said CPU to said membrane assembly, and wherein said membrane assembly transforms the electrical audio signal received from said CPU into the low-frequency air vibrations.

9. The device as claimed in claim 2 or claim 1, further comprising an adaptor member configured to receive and securely retain said membrane assembly, wherein said adaptor member comprises a generally central aperture extending through said adaptor member.

10. The device as claimed in claim 1, wherein said lower portion of said main node assembly comprises the manifold having a first and second openings, wherein said first opening is configured to receive said pressure sensor and said second opening is configured to receive said adaptor member with said membrane assembly mounted therein.

11. The device as claimed in claim, 1 wherein said upper portion of said main node assembly comprises a plurality of fins that longitudinally extend along said upper portion and a plurality of spaced-apart air vibration nozzles each in fluid communication with said second opening of said manifold.

12. The device as claimed in claim 1, wherein each of said air vibration nozzles is disposed between a respective pair of said fins such that the low-frequency air vibrations generated by said membrane assembly exit said air vibration nozzles and travel along and between said respective pair of fins and into said inner tube of said housing assembly.

13. The device as claimed in claim, 2 or claim 1, wherein said upper portion of said main node assembly comprises an intermediate neck member disposed below said plurality of fins, and wherein said intermediate neck member comprises at least one sealing ring adapted to facilitate an interference fit of said upper portion within said inner tube of said housing assembly.

14. The device as claimed in claim 13, wherein said intermediate neck member of said main node assembly is separated from said lower portion of said main node assembly by a base member that is configured to cover said open component end of said housing assembly when said upper portion of said main node assembly is inserted into said inner tube of said housing assembly.

15. The device as claimed in claim 2 or claim 1, wherein said upper portion of said main node assembly comprises a generally central cavity longitudinally extending along said upper portion and configured to securely receive and retain a lower portion of said heatable element, and wherein said lower portion of said heatable element is electrically connected to a power supply.

16. The device as claimed in claim 2 or claim 1, wherein said housing assembly comprises a generally hollow duct longitudinally extending between said inner tube and an interior surface of said sidewall of said housing assembly, and wherein said hollow duct is fluidly connected with said pressure sensor and said inner tube.

17. A device for heating a smokable material to generate a compound inhalable by a user, said device comprising:

an elongate housing assembly having a sidewall with an outer surface and an interior surface, said housing assembly comprising a hollow inner tube longitudinally extending therethrough, wherein said inner tube is spaced from said interior surface of said sidewall of said housing assembly;

a cartridge containing the smokable material, said cartridge is disposed within said inner tube;

a main node assembly comprising an upper portion and a lower portion, said upper portion is configured to be inserted into said inner tube and comprising a generally cylindrical and longitudinally extending node member, wherein the longitudinally extending node member includes a plurality of fins;

wherein said lower portion of said main node assembly comprises (i) a pressure sensor configured to detect a drop in pressure in said inner tube and (ii) a membrane assembly configured to generate low-frequency air vibrations in response to a signal received from said pressure sensor; and a pin heater configured to be securely received by said upper portion of said main node assembly;

wherein said sidewall of said housing assembly defines an aperture, wherein said housing assembly comprises an air canal extending between said inner tube and said interior surface of said sidewall, and wherein said canal is connected in fluid communication with said aperture and said inner tube to provide an air supply into said inner tube through said air canal; and wherein said pin heater is configured to be inserted into said cartridge and selectively activated to heat and volatilize the smokable material, wherein the upper portion of the main node assembly comprises a plurality of spaced-apart air vibration nozzles each in fluid communication with a second opening of a manifold of the lower node portion, and wherein each of the air vibration nozzles is disposed between a respective pair of fins that longitudinally extend along the upper portion of the main node assembly such that the low-frequency air vibrations generated by the membrane assembly exit the air vibration nozzles and travel upwards between the respective pair of fins and into said inner tube of the housing assembly.

18. The device as claimed in claim 17, wherein said cartridge containing the smokable material comprises an open end through which volatilized smokable material enters said inner tube of said housing assembly and mixes with the air supply delivered through said canal into said inner tube to form the compound inhalable by the user.

19. The device as claimed in claim 17 further comprising an adaptor member configured to receive and securely retain said membrane assembly, wherein said adaptor member comprises a generally central aperture extending through said adaptor member, wherein said lower portion of said main node assembly comprises the manifold with a first and second openings, wherein said first opening is configured to receive said pressure sensor and said second opening is configured to receive said adaptor member with said membrane assembly mounted therein.

20. The device as claimed in claim 17, wherein the device further comprising (i) a central processing unit (CPU) communicatively connected to said pressure sensor, membrane assembly and pin heater and (ii) a power supply that is connected through said CPU with said pressure sensor, wherein said CPU is operable to control said pressure sensor and membrane assembly and monitor and control temperature of said pin heater.

* * * * *